US009500074B2

(12) United States Patent
Tips

(10) Patent No.: US 9,500,074 B2
(45) Date of Patent: Nov. 22, 2016

(54) ACOUSTIC COUPLING OF ELECTRICAL POWER AND DATA BETWEEN DOWNHOLE DEVICES

(71) Applicant: Halliburton Energy Services, Inc., Houston, TX (US)

(72) Inventor: Timothy R. Tips, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/328,984

(22) Filed: Jul. 11, 2014

(65) Prior Publication Data

US 2015/0034305 A1 Feb. 5, 2015

(30) Foreign Application Priority Data

Jul. 31, 2013 (WO) ..... PCT/US2013/053100

(51) Int. Cl.
*E21B 47/16* (2006.01)
*E21B 47/12* (2012.01)

(52) U.S. Cl.
CPC ..... *E21B 47/16* (2013.01); *E21B 47/12* (2013.01)

(58) Field of Classification Search
CPC ..... E21B 47/16; E21B 43/003; E21B 47/00; E21B 43/2401; E21B 49/005; G01V 1/44; G01V 1/50
See application file for complete search history.

(56) References Cited

U.S. PATENT DOCUMENTS

| | | | | |
|---|---|---|---|---|
| 5,914,911 | A | 6/1999 | Babour et al. | |
| 6,061,000 | A | 5/2000 | Edwards | |
| 6,343,649 | B1 | 2/2002 | Beck et al. | |
| 6,684,952 | B2 | 2/2004 | Brockman et al. | |
| 6,912,177 | B2 | 6/2005 | Smith | |
| 7,234,519 | B2 | 6/2007 | Fripp et al. | |
| 2007/0030762 | A1* | 2/2007 | Huang | E21B 47/182 367/83 |
| 2007/0227776 | A1 | 10/2007 | Huang et al. | |
| 2013/0087325 | A1* | 4/2013 | Bartko | E21B 41/0035 166/250.1 |

OTHER PUBLICATIONS

Int'l Search Report and Written Opinion; KIPO; PCT/US2013/053100; Apr. 7, 2014.

Sherrit et al.; 1 kW Power Transmission Using Wireless Acoustic-Electric Feedthrough (WAEF); Earth & Space 2008: Engineering, Science, Construction, and Operations in Challenging Environments; Mar. 3-5, 2008, Long Beach, California, United States.

* cited by examiner

*Primary Examiner* — Zakiya W Bates
(74) *Attorney, Agent, or Firm* — Haynes and Boone, LLP

(57) ABSTRACT

An apparatus for communicating electrical power and data between downhole devices. The apparatus includes a wellbore tubular having a wall. An electrical device is positioned in a wellbore region to an exterior of the wellbore tubular. A first acoustic coupling element is positioned to the exterior of the wellbore tubular and is electrically connected to the electrical device. A second acoustic coupling element is positioned to an interior of the wellbore tubular. The second acoustic coupling element is operable to transmit electrical power to and receive data from the first acoustic coupling element through communication of acoustic signals through the wall of the wellbore tubular.

20 Claims, 4 Drawing Sheets

ACOUSTIC COUPLING OF ELECTRICAL POWER AND DATA BETWEEN DOWNHOLE DEVICES

CROSS-REFERENCE TO RELATED APPLICATIONS

This application claims the benefit under 35 U.S.C. §119 of the filing date of International Application No. PCT/US2013/053100, filed Jul. 31, 2013.

TECHNICAL FIELD OF THE DISCLOSURE

This disclosure relates, in general, to equipment utilized in conjunction with operations performed in subterranean wells and, in particular, to transmitting electrical power and data between downhole devices through communication of acoustic signals through the wall of a wellbore tubular.

BACKGROUND OF THE DISCLOSURE

Without limiting the scope of the present invention, its background is described with reference to providing communication and sensing during a production operation within a subterranean wellbore environment, as an example.

It is well known in the subterranean well completion and production arts that downhole sensors can be used to monitor a variety of parameters in the wellbore environment. For example, during production operations, it may be desirable to monitor a variety of downhole parameters such as temperatures, pressures, pH, flowrates and the like in a variety of downhole locations. Transmission of this information to the surface may then allow the operator to modify and optimize the production operations. One way to transmit this information to the surface and provide power to such sensors is by using a wired communication path such as an electrical conductor.

Due to the desired location of certain downhole sensors such as in a B annulus, at a sand face, on the exterior of a screen, in a lateral branch or like, it has been found that it is difficult to establish a reliable wired communication path as a wet connection is typically required. For example, to achieve a wet connection of an electrical conductor, a connector associated with an uphole portion of the electrical conductor must be run downhole, aligned with and coupled to a connector associated with a downhole portion of the electrical conductor that was previously installed in the well. This intricate connection must be made thousands of feet downhole without the ability to see the mating components and without damaging the connectors or the electrical conductors disposed therein. In addition, wellbore fluids must not be allowed to enter or must be removed from the connectors prior to the mating process. In addition, it has been found, that even after a wet connection has been successfully established, over time communication through the connector joint may become compromised or the connector joint may fail rendering useless any sensors associated therewith. Accordingly, a need has arisen for an improved apparatus and method for transmitting electrical power to and retrieving data from downhole sensors.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION OF THE DISCLOSURE

Figure 1:
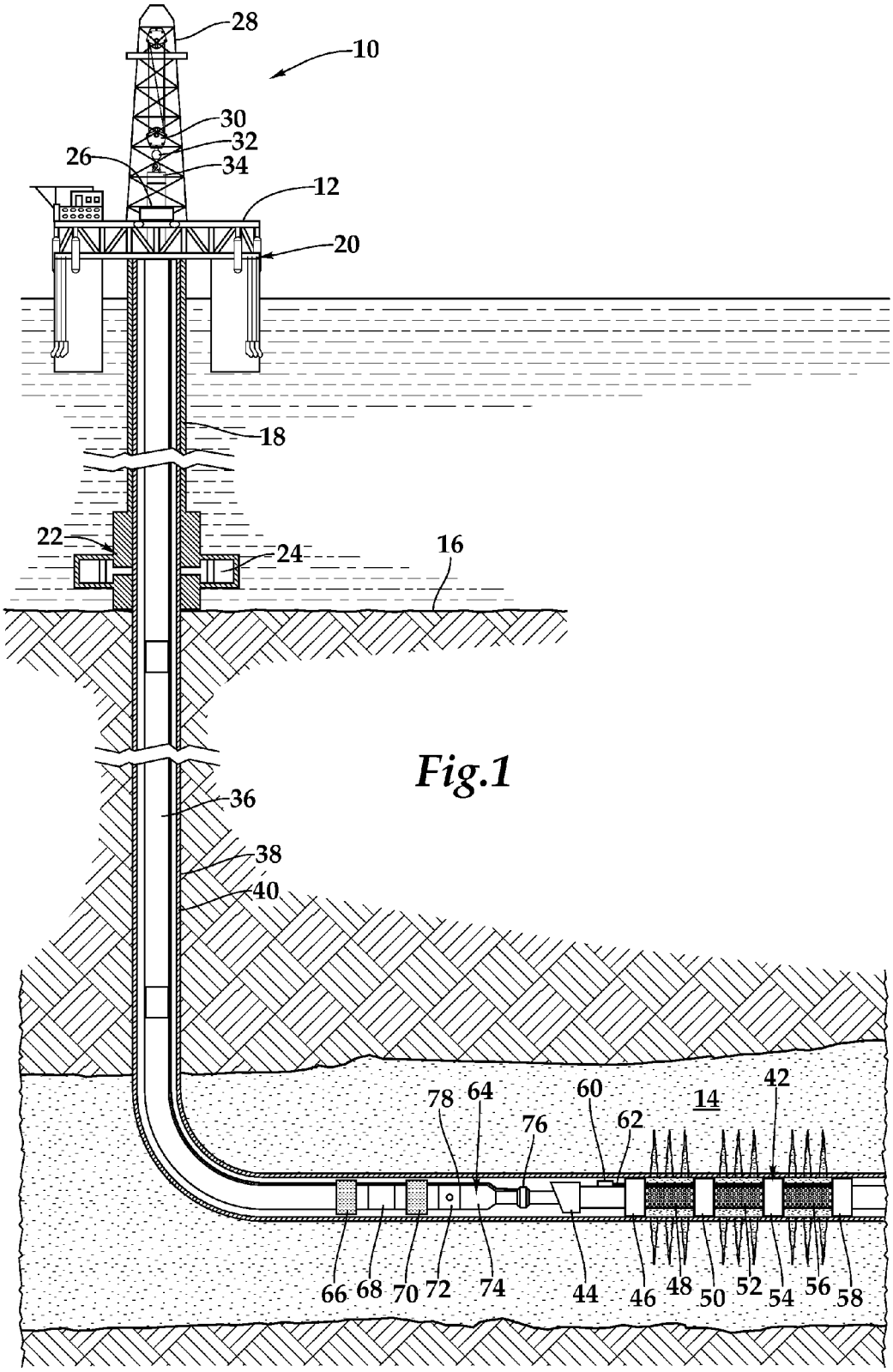
FIG. 1 is a schematic illustration of an offshore oil and gas platform installing an upper completion assembly into a well having a lower completion assembly disposed therein according to an embodiment of the present disclosure.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

In one aspect, the present disclosure is directed to an apparatus for transmitting electrical power and data between downhole devices. The apparatus includes a wellbore tubular having a wall. An electrical device is positioned in a wellbore region to an exterior of the wellbore tubular. A first acoustic coupling element is positioned to the exterior of the wellbore tubular and is electrically connected to the electrical device. A second acoustic coupling element is positioned to an interior of the wellbore tubular. The second acoustic coupling element is operable to transmit electrical power to and receive data from the first acoustic coupling element through communication of acoustic signals through the wall of the wellbore tubular.

In one embodiment, the second acoustic coupling element may be a piezoelectric generator and the first acoustic coupling element may be a piezoelectric receiver. In some embodiments, the first acoustic coupling element may be operable to transmit data to the second acoustic coupling element through communication of acoustic signals through the wall of the wellbore tubular. In certain embodiments, the acoustic signals may be communicated at a resonance frequency of the first and second acoustic coupling elements. In one embodiment, the first acoustic coupling element may be mechanically coupled to an outer surface of the wall of the wellbore tubular by a bonding layer. In another embodiment, the first acoustic coupling element may be mechanically coupled to an outer surface of the wall of the wellbore tubular by a compressive force. In some embodiments, the second acoustic coupling element may be mechanically coupled to an inner surface of the wall of the wellbore tubular by a compressive force. In certain embodiments, the first and second acoustic coupling elements are positioned in communicative proximity to a surface of the wall of the wellbore tubular. In one embodiment, the first and second acoustic coupling elements may be oppositely disposed relative to each other on an outer surface of the wall of the wellbore tubular and an inner surface of the wall of the wellbore tubular, respectively. In some embodiments, the second acoustic coupling element may be electrically coupled to a surface controller by an electrical cable. In certain embodiments, the electrical device may be selected from the group consisting of downhole sensors, downhole controllers, downhole actuators and fluid flow control devices.

In another aspect, the present disclosure is directed to a method for transmitting electrical power and data between downhole devices. The method includes disposing a first acoustic coupling element to an exterior of a wellbore tubular having a wall, the first acoustic coupling element electrically connected to an electrical device positioned to the exterior of the wellbore tubular; positioning a second acoustic coupling element to an interior of the wellbore tubular; transmitting electrical power from the second acoustic coupling element to the first acoustic coupling element through communication of acoustic signals through the wall of the wellbore tubular; and receiving data at the second acoustic coupling element from the first acoustic coupling element through communication of acoustic signals through the wall of the wellbore tubular.

The method may also include mechanically coupling the first acoustic coupling element to an outer surface of the wall of the wellbore tubular using at least one of a bonding layer and a compressive force; mechanically coupling the second acoustic coupling element to an interior surface of the wall of the wellbore tubular using a compressive force; positioning the first acoustic coupling element in communicative proximity of the wall of the wellbore tubular; positioning the second acoustic coupling element in communicative proximity of the wall of the wellbore tubular; exciting a piezoelectric generator of the first acoustic coupling element and a piezoelectric receiver of the second acoustic coupling element; exciting the piezoelectric generator and the piezoelectric receiver at a resonance frequency; electrically coupling the second acoustic coupling element to a surface controller by an electrical cable and/or transmitting data from the first acoustic coupling element to the second acoustic coupling element through communication of acoustic signals through the wall of the wellbore tubular.

In a further aspect, the present disclosure is directed to an apparatus for transmitting electrical power and data between downhole devices. The apparatus includes a surface controller and a wellbore tubular having a wall. An electrical device is positioned in a wellbore region to an exterior of the wellbore tubular. A first acoustic coupling element includes a piezoelectric receiver positioned to the exterior of the wellbore tubular and in communicative proximity of the wall of the wellbore tubular. The first acoustic coupling element is electrically connected to the electrical device. A second acoustic coupling element has a piezoelectric generator positioned to an interior of the wellbore tubular, in communicative proximity of the wall of the wellbore tubular and oppositely disposed relative to the first acoustic coupling element. The second acoustic coupling element is electrically coupled to the surface controller by an electrical cable. The second acoustic coupling element is operable to transmit electrical power to and receive data from the first acoustic coupling element through communication of acoustic signals through the wall of the wellbore tubular.

Referring initially to FIG. 1, an upper completion assembly is being installed in a well having a lower completion assembly disposed therein from an offshore oil or gas platform that is schematically illustrated and generally designated 10. A semi-submersible platform 12 is positioned over submerged oil and gas formation 14 located below sea floor 16. A subsea conduit 18 extends from deck 20 of platform 12 to a subsea wellhead installation 22, including blowout preventers 24. Platform 12 has a hoisting apparatus 26, a derrick 28, a travel block 30, a hook 32 and a swivel 34 for raising and lowering pipe strings, such as a substantially tubular, axially extending tubing string 36.

A wellbore 38 extends through the various earth strata including formation 14 and has a casing string 40 cemented therein. Disposed in a substantially horizontal portion of wellbore 38 is a lower completion assembly 42 that includes various tools such as an orientation and alignment subassembly 44, a packer 46, a sand control screen assembly 48, a packer 50, a sand control screen assembly 52, a packer 54, a sand control screen assembly 56 and a packer 58. Positioned to the exterior of lower completion assembly 42 is an acoustic coupling element 60. Extending downhole from acoustic coupling element 60 is one or more communication cables such as electric cable 62 that passes through packers 46, 50, 54 and is operably associated with one or more electrical devices associated with lower completion assembly 42 such as sensors position on sand control screen assemblies 48, 52, 56 or at the sand face of formation 14, downhole controllers or actuators used to operate downhole tools or directly with downhole tools such as fluid flow control devices. Electric cable 62 may operate as communication media to transmit power, data and the like between acoustic coupling element 60 and the electrical devices associated with lower completion assembly 42.

Disposed in wellbore 38 at the lower end of tubing string 36 is an upper completion assembly 64 that includes various tools such as a packer 66, an expansion joint 68, a packer 70, a fluid flow control module 72 and an anchor assembly 74. Upper completion assembly 64 also includes an acoustic coupling element 76. Extending uphole from acoustic coupling element 76 are one or more communication cables such as electric cable 78 that passes through packers 66, 70 and extends to the surface in the annulus between tubing string 36 and casing 40. Electric cable 78 may operate as a communication media to transmit power, data and the like between a surface controller (not pictured) and acoustic coupling element 76.

Even though FIG. 1 depicts a horizontal wellbore, it should be understood by those skilled in the art that the apparatus according to the present disclosure is equally well suited for use in wellbores having other orientations including vertical wellbores, slanted wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Figure 2:
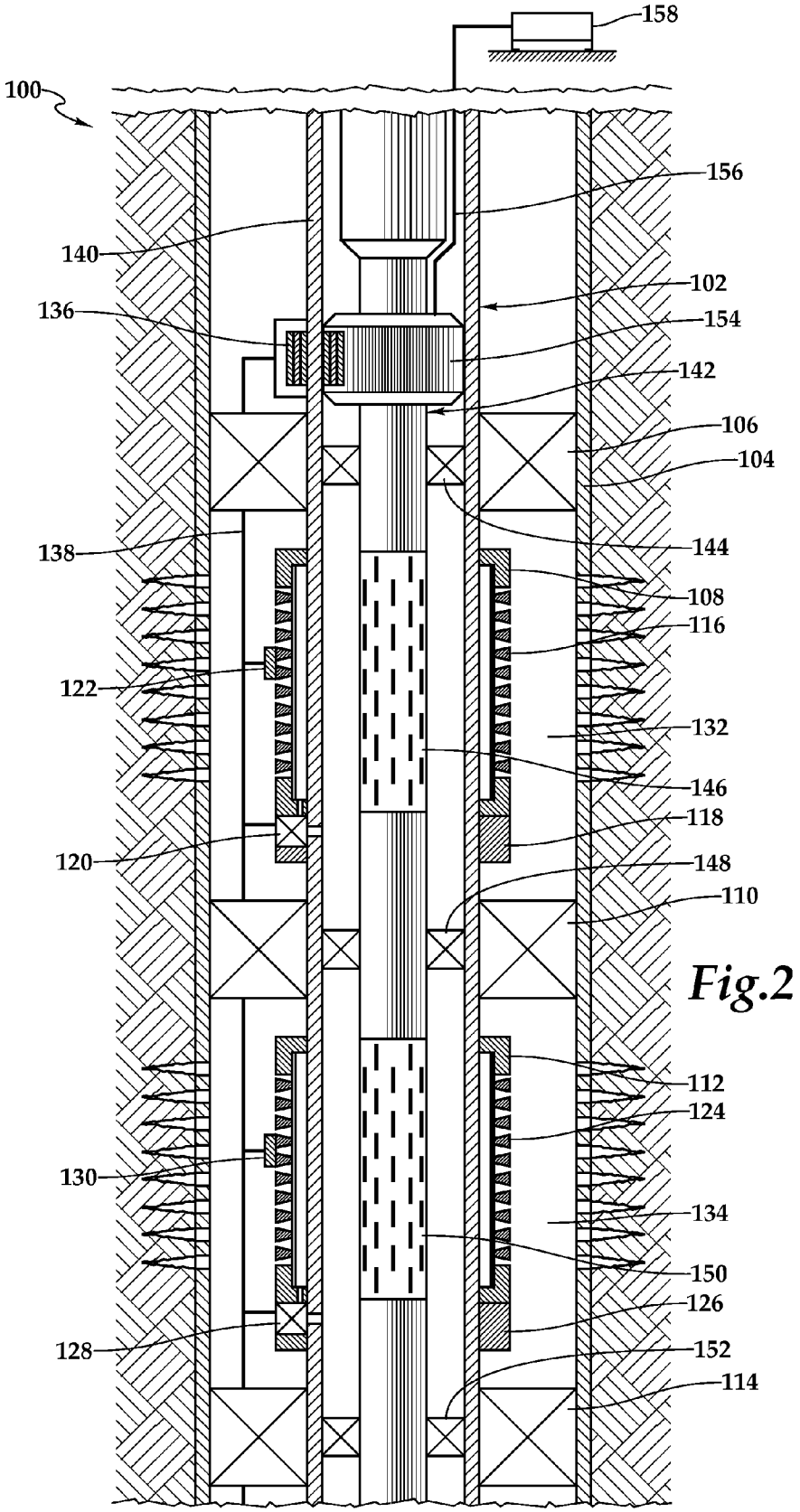
FIG. 2 is a schematic illustration of a multi zone completion including an apparatus for transmitting electrical power and data between downhole devices according to an embodiment of the present disclosure.

Referring next to FIG. 2, therein is depicted a multi zone completion including an apparatus for transmitting electrical power and data between downhole devices that is generally designated 100. A lower completion assembly 102 has been positioned in cased wellbore 104. In the illustrated section, lower completion assembly 102 includes a packer 106, a flow control screen assembly 108, a packer 110, a flow control screen assembly 112 and a packer 114. Flow control screen assembly 108 includes a filter section 116 and a flow control section 118 that may include various devices for controlling the inflow of production fluids and outflow of injection fluids such as one or more downhole controllers, one or more downhole actuators and/or one or more fluid flow control devices that are collectively depicted as fluid flow control system 120. Preferably, at least one of the components of fluid flow control system 120 is electrically operated. Not all of the components of fluid flow control system 120 need to be electrically operated, for example, fluid flow control system 120 may include an electrically operated actuator that serves as a pilot to open or close a fluid path enabling pressure to operate a fluid flow control device. In the illustrated embodiment, flow control screen assembly 108 also has associated therewith one or more sensors 122 such as one or more temperature sensors, pressure sensors, pH sensors, flowrate sensors, fluid composition sensors or other desired wellbore sensor. Preferably, sensors 122 are electrically operated sensors.

Flow control screen assembly 112 includes a filter section 124 and a flow control section 126 that may include various devices for controlling the inflow of production fluids and outflow of injection fluids such as one or more downhole controllers, one or more downhole actuators and/or one or more fluid flow control devices that are collectively depicted as fluid flow control system 128. In the illustrated embodiment, flow control screen assembly 112 also has associated therewith one or more sensors 130 such as one or more temperature sensors, pressure sensors, pH sensors, flowrate sensors, fluid composition sensors or other desired wellbore sensor. Together, packer 106, flow control screen assembly 108 and packer 110 may be referred to as a zonal isolation subassembly associated within zone 132. Likewise, packer 110, flow control screen assembly 112 and packer 114 may be referred to as a zonal isolation subassembly associated within zone 134. As should be understood by those skilled in the art, even though FIG. 2 depicts two zones 132, 134, lower completion assembly 102 may include any number of zonal isolation subassemblies associated with any number of zones.

On an exterior portion thereof, lower completion assembly 102 includes an acoustic coupling element 136. Extending downhole from acoustic coupling element 136 is one or more communication paths depicted as communication cable 138 that is electrically coupled to sensors 122, 130 and fluid flow control systems 120, 128 as well as other electrical devices that may be associated with lower completion assembly 102, for example, additional electrical devices positioned downhole of packer 114. In the illustrated embodiment, the active components of acoustic coupling element 136 are radially disposed in communicative proximity of and preferably in contact with the wall of wellbore tubular 140 under a compressive or bonding force, thereby mechanically coupling acoustic coupling element 136 with the wall of wellbore tubular 140. Acoustic coupling element 136 is operable to generate electricity responsive to receiving acoustic signals through the wall of wellbore tubular 140 of lower completion assembly 102 and to supply electrical power to sensors 122, 130 and fluid flow control systems 120, 128 via communication cable 138. In addition, acoustic coupling element 136 is operably to transmit data obtained by sensors 122, 130 or information regarding the state of fluid flow control systems 120, 128 by sending acoustic signals through the wall of wellbore tubular 140.

Disposed at least partially within lower completion assembly 102 is an upper completion assembly 142. In the illustrated embodiment, upper completion assembly 142 includes a seal assembly 144, a slotted tubing section 146, a seal assembly 148, a slotted tubing section 150 and a seal assembly 152. As illustrated, slotted tubing section 146 corresponds with flow control screen assembly 108 and zone 132 while slotted tubing section 150 corresponds with flow control screen assembly 112 and zone 134. Upper completion assembly 142 may include additional seal assemblies and slotted tubing sections to correspond with additional flow control screen assemblies and zones. Upper completion assembly 142 also includes an acoustic coupling element 154. Extending uphole of acoustic coupling element 154 are one or more communication paths depicted as communication cable 156 that electrically connects acoustic coupling element 154 to a surface controller 158. Surface controller 158 is operable to supply electrical power to acoustic coupling element 154, which in turn is operable to generate acoustic signals that are communicated through the wall of wellbore tubular 140 to acoustic coupling element 136. In addition, acoustic coupling element 154 is operable to received data transmitted by acoustic coupling element 136 via acoustic signals transmitted through the wall of wellbore tubular 140 and then send the data to surface controller 158 via communication cable 156.

Preferably, acoustic coupling element 154 is run downhole as part of upper completion assembly 142 in a radially contracted configuration. As upper completion assembly 142 is lowered in lower completion assembly 102, the interaction of alignment subassembly 44 of lower completion assembly 102 and anchor assembly 74 of upper completion assembly 142 (see FIG. 1) rotates upper completion assembly 142 relative to lower completion assembly 102 in a known manner to circumferentially align the active components of acoustic coupling element 154 with those of acoustic coupling element 136. Once acoustic coupling element 154 and acoustic coupling element 136 are axially and circumferentially aligned, the active components of acoustic coupling element 154 may be radially extended to bring the active components of acoustic coupling element 154 into communicative proximity of and preferably in contact with the wall of wellbore tubular 140 under a compressive force, thereby mechanically coupling acoustic coupling element 154 with the wall of wellbore tubular 140. In this configuration, the active components of acoustic coupling element 154 and acoustic coupling element 136 are preferably oppositely disposed relative to each other on the inner surface of the wall of wellbore tubular 140 and the outer surface of the wall of wellbore tubular 140, respectively, as depicted in FIG. 2. It should be understood by those skilled in the art that while mechanically coupling acoustic coupling elements 136, 154 with the wall of wellbore tubular 140 and oppositely disposing acoustic coupling elements 136, 154 relative to each other on the wall of wellbore tubular 140 enhances power transfer efficiency, these configurations are not required as long as acoustic coupling elements 136, 154 are in communicative proximity with the wall of wellbore tubular 140, thereby able to communicate acoustic signals through the wall of wellbore tubular 140.

In operation, surface controller 158 is used to send electrical signals in the form of electrical power and/or data streams to acoustic coupling element 154 on an intermittent or continuous basis. The electrical signals are converted to acoustic signals in acoustic coupling element 154 by the active elements therein, for example, a stack of piezoelectric ceramic elements. The acoustic signals are communicated through the wall of wellbore tubular 140 and are received by the active elements of acoustic coupling element 136, for example, a stack of piezoelectric ceramic elements, that convert the acoustic signals to electrical signals. In this implementation, acoustic coupling element 154 may be referred to as a piezoelectric generator and acoustic coupling element 136 may be referred to as a piezoelectric receiver. The electrical signals generated by acoustic coupling element 136 may be used to power downhole devices such as sensors 122, 130 and fluid flow control systems 120, 128 or send commands to such devices, for example, commands for sensors to obtain wellbore information or commands for a wellbore device to be actuated from one position to another.

In this configuration, acoustic coupling element 136 uses an indirect piezoelectric effect to generate stress waves that are transmitted through the wall of wellbore tubular 140 where the received waves are converted to electric signals using a direct piezoelectric effect by acoustic coupling element 154 to generate electricity for delivery to downhole electrical devices. In a similar manner, data obtained by sensors 122, 130 as well as other downhole information such as successful actuation of components in fluid flow control systems 120, 128 may be transmitted from acoustic coupling element 136 to acoustic coupling element 154 wherein acoustic coupling element 136 uses an indirect piezoelectric effect to generate stress waves that are transmitted through the wall of wellbore tubular 140 where the received waves are converted to electric signals using a direct piezoelectric effect by acoustic coupling element 136 for delivery to surface controller 158. Preferably, power and data transmissions between acoustic coupling elements 136, 154 are accomplished through acoustic signals at the harmonic or a higher order resonance frequency to enhance power transfer efficiency.

Figure 3:
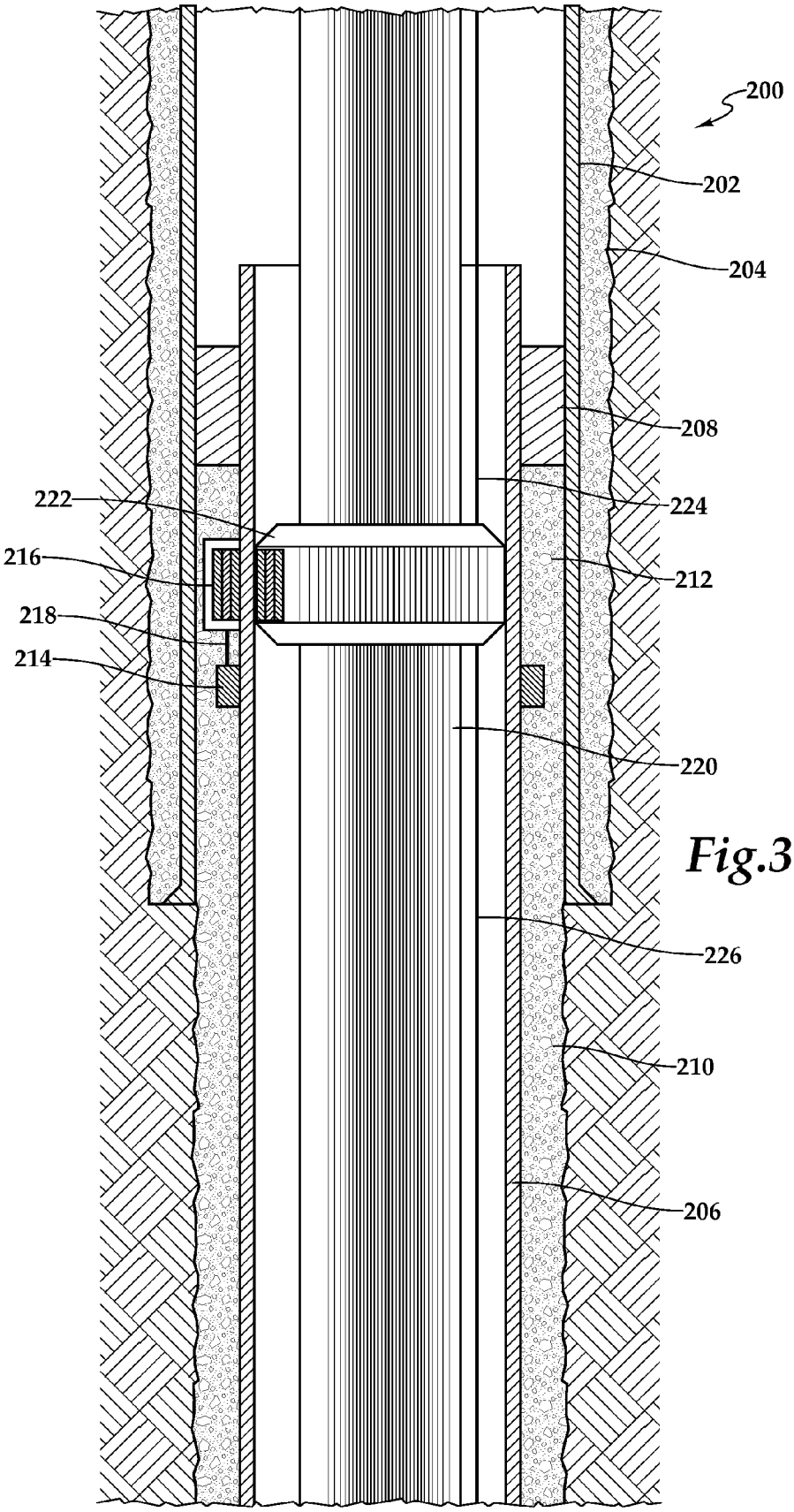
FIG. 3 is a schematic illustration of a casing annulus environment including an apparatus for transmitting electrical power and data between downhole devices according to an embodiment of the present disclosure.

Referring next to FIG. 3, therein is depicted a casing annulus environment such as a B or C annulus associated with a subsea wellhead completion including an apparatus for transmitting electrical power and data between downhole devices that is generally designated 200. A casing string 202 is cemented in a wellbore 204. A liner string 206 has been installed within casing string 202 and is supported by a liner hanger 208. A cement layer 210 has been positioned around liner string 206 including in annulus 212 between liner string 206 and casing string 202. One or more sensor 214, such as pressure and/or temperature sensors has been installed in annulus 212 to monitor casing annulus pressure and enable manage of potential annulus pressure build-up due to, for example, thermally induced annular fluid expansion during well production. However, unlike dry wellheads where casing pressures can be monitored and managed by porting directly into the wellhead, in subsea wellhead completions, such porting is disfavored and in some jurisdictions forbidden. While certain battery operated sensors may provide a temporary solution, subsea completions require long term and reliable pressure monitoring of the casing annuli. In the illustrated embodiment, liner string 206 includes an acoustic coupling element 216 positioned exteriorly thereof. Extending downhole from acoustic coupling element 216 is a communication cable 218 that is electrically coupled to sensor 214. Acoustic coupling element 216 is operable to generate electricity responsive to receiving acoustic signals through the wall of liner string 206 and to supply electrical power to sensor 214 via communication cable 218. In addition, acoustic coupling element 216 is operably to transmit data obtained by sensor 214 by sending acoustic signals through the wall of liner string 206.

Disposed at least partially within liner string 206 is a tubular string 220 that includes an acoustic coupling element 222. Extending uphole of acoustic coupling element 222 are one or more communication paths depicted as communication cable 224 that electrically connects acoustic coupling element 222 to a surface controller (not pictured). In addition, one or more communication paths depicted as communication cable 226 extend downhole from acoustic coupling element 222 and may provide electrical signals to other similar acoustic coupling element downhole thereof. The surface controller is operable to supply electrical power to acoustic coupling element 222, which in turn is operable to generate acoustic signals that are communicated through the wall of liner string 206 to acoustic coupling element 216. In addition, acoustic coupling element 222 is operable to received data transmitted by acoustic coupling element 216 via acoustic signals transmitted through the wall of liner string 206 and then send the data to the surface controller via communication cable 224.

Preferably, acoustic coupling element 222 is run downhole as part of tubing string 220 in a radially contracted configuration. Once acoustic coupling element 222 and acoustic coupling element 216 are axially and circumferentially aligned, the active elements of acoustic coupling element 222 are radially extended to bring the active components of acoustic coupling element 222 into communicative proximity of and preferably in contact with the wall of liner string 206 under a compressive force. In this configuration, the active components of acoustic coupling element 222 and acoustic coupling element 218 are oppositely disposed relative to each other on the inner and outer surfaces of liner string 206, respectively.

In operation, the surface controller is used to send electrical signals in the form of electrical power and/or data streams to acoustic coupling element 222 on an intermittent or continuous basis. The electrical signals are converted to acoustic signals in acoustic coupling element 222 by the active elements of acoustic coupling element 222 which may be a stack of piezoelectric ceramic elements. The acoustic signals are communicated through the wall of liner string 206 and are received by the active elements of acoustic coupling element 216 which may also be a stack of piezoelectric ceramic elements, that convert the acoustic signals to electrical signals. The electrical signals generated by acoustic coupling element 216 may be used to power sensor 214 and send commands to sensor 214 to obtain and provide wellbore information.

In this configuration, acoustic coupling element 222 uses an indirect piezoelectric effect to generate stress waves that are transmitted through the wall of liner string 206 where the received waves are converted to electric signals using a direct piezoelectric effect by acoustic coupling element 216 to generate electricity for delivery to sensor 214. In a similar manner, data obtained by sensor 214 may be transmitted from acoustic coupling element 216 to acoustic coupling element 222 wherein acoustic coupling element 216 uses an indirect piezoelectric effect to generate stress waves that are transmitted through the wall of liner string 206 where the received waves are converted to electric signals using a direct piezoelectric effect by acoustic coupling element 222 for delivery to the surface controller.

Figure 4:
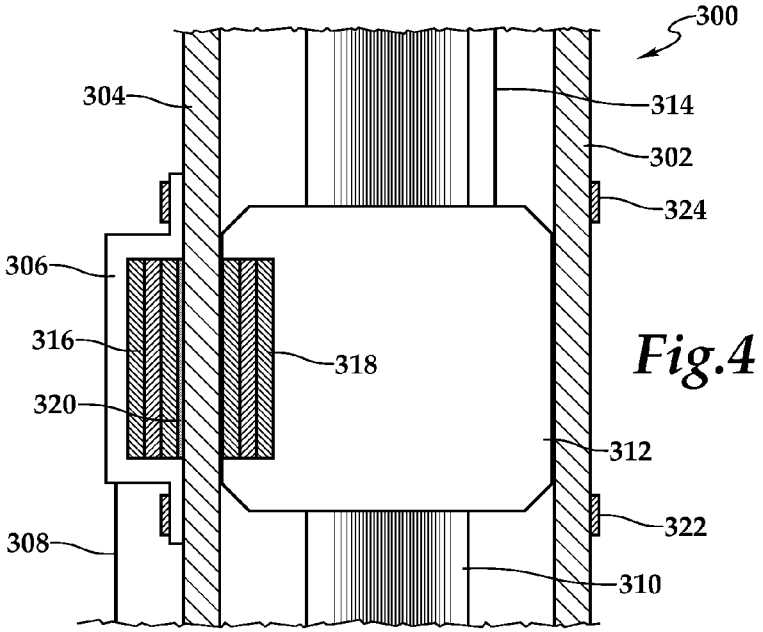
FIG. 4 is a schematic illustration of an apparatus for transmitting electrical power and data between downhole devices according to an embodiment of the present disclosure.

Referring next to FIG. 4, therein is depicted an apparatus for transmitting electrical power and data between downhole devices that is schematically illustrated and generally designated 300. In the illustrated embodiment, apparatus 300 includes a wellbore tubular 302 having a wall 304. An acoustic coupling element 306 is positioned to the exterior of wellbore tubular 302. Acoustic coupling element 306 is electrically connected to one or more electrical devices (not pictured) by a communication cable 308. Disposed within wellbore tubular 302 is a tubing string 310. Interconnected in tubing string 310 is an acoustic coupling element 312, thereby positioning acoustic coupling element 312 to the interior of wellbore tubular 304. Acoustic coupling element 312 is electrically connected to a surface controller (not pictured) by a communication cable 314. In the illustrated embodiment, acoustic coupling element 306 includes a plurality of active elements depicted as a stack of piezoelectric ceramic elements 316. In addition, acoustic coupling element 306 may include one or more control elements as well as additional electronic components such as memory. Likewise, acoustic coupling element 312 includes a plurality of active elements depicted as a stack of piezoelectric ceramic elements 318. In addition, acoustic coupling element 312 may include one or more control elements as well as additional electronic components such as a microprocessor and memory. Acoustic coupling element 312 may be run downhole in a radially contracted configuration and, responsive to electrical or mechanical commands, at least the portion of acoustic coupling element 312 containing piezoelectric ceramic elements 318 may be radially extended.

In the illustrated embodiment, piezoelectric ceramic elements 316 of acoustic coupling element 306 are oppositely disposed relative to piezoelectric ceramic elements 318 of acoustic coupling element 312 on the outer and inner surfaces of wellbore tubular 304. To enhance power transfer efficiency, acoustic coupling element 306 is preferably mechanically coupled to the outer surface of wellbore tubular 304 and acoustic coupling element 312 is preferably mechanically coupled to the inner surface of wellbore tubular 304. In the illustrated embodiment, acoustic coupling element 306 is mechanically coupled to the outer surface of wellbore tubular 304 by a bonding layer 320 such as a high temperature epoxy. In addition, acoustic coupling element 306 is mechanically coupled to the outer surface of wellbore tubular 304 by a compressive force generated by pipe body clamps 322, 324 that encircle wellbore tubular 304. Preferably, acoustic coupling element 312 is mechanically coupled to the inner surface of wellbore tubular 304 by a compressive force generated by radially expanding acoustic coupling element 312.

In operation, the surface controller is used to send electrical signals in the form of electrical power and/or data streams to acoustic coupling element 312 on an intermittent or continuous basis. The electrical signals are converted to acoustic signals in acoustic coupling element 312 by piezoelectric ceramic elements 318. The acoustic signals are communicated through wall 304 of wellbore tubular 302 and are received by piezoelectric ceramic elements 316 of acoustic coupling element 306 that convert the acoustic signals to electrical signals.

In this implementation, piezoelectric ceramic elements 318 act as a piezoelectric generator that use the indirect piezoelectric effect to generate stress waves that are transmitted through wall 304 of wellbore tubular 302 where the received waves are converted to electric signals using the direct piezoelectric effect by piezoelectric ceramic elements 316, which act as a piezoelectric receiver. In a similar manner, data may be transmitted from acoustic coupling element 306 to acoustic coupling element 312 by piezoelectric ceramic elements 316 which act as a piezoelectric generator using the indirect piezoelectric effect to generate stress waves that are transmitted through wall 304 of wellbore tubular 302 where the received waves are converted to electric signals using the direct piezoelectric effect by piezoelectric ceramic elements 318, which act as a piezoelectric receiver. To enhance power transfer efficiency, power and data transmissions between acoustic coupling elements 306, 312 may be accomplished through acoustic signals at the harmonic or a higher order resonance frequency of piezoelectric ceramic elements 316, 318.

Figure 5:
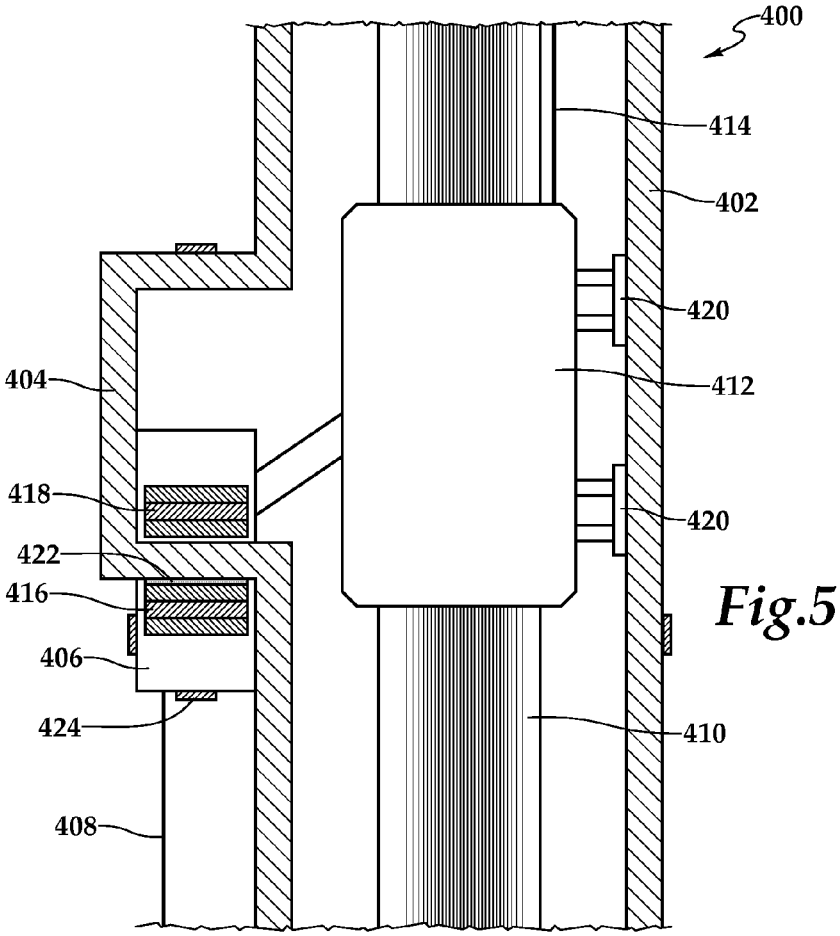
FIG. 5 is a schematic illustration of an apparatus for transmitting electrical power and data between downhole devices according to an embodiment of the present disclosure.

Referring next to FIG. 5, therein is depicted an apparatus for transmitting electrical power and data between downhole devices that is schematically illustrated and generally designated 400. In the illustrated embodiment, apparatus 400 includes a wellbore tubular 402 having a side pocket 404. An acoustic coupling element 406 is positioned to the exterior of wellbore tubular 402. Acoustic coupling element 406 is electrically connected to one or more electrical devices (not pictured) by a communication cable 408. Disposed within wellbore tubular 402 is a tubing string 410. Interconnected in tubing string 410 is an acoustic coupling element 412, thereby positioning acoustic coupling element 412 to the interior of wellbore tubular 404. Acoustic coupling element 412 is electrically connected to a surface controller (not pictured) by a communication cable 414 which may be a flat pack cable including multiple electrical lines and well as one or more hydraulic lines. In the illustrated embodiment, acoustic coupling element 406 includes a plurality of active elements depicted as a stack of piezoelectric ceramic elements 416. In addition, acoustic coupling element 406 may include one or more control elements as well as additional electronic components such as memory. Likewise, acoustic coupling element 412 includes a plurality of active elements depicted as a stack of piezoelectric ceramic elements 418. In addition, acoustic coupling element 412 may include one or more electrical or hydraulic control elements as well as additional electronic components such as a microprocessor and memory. Preferably, acoustic coupling element 412 is run downhole in a radially contracted configuration and, responsive to electrical or hydraulic commands, one or more support structure 420 are radially extended and the portion of acoustic coupling element 412 containing piezoelectric ceramic elements 418 is radially extended into side pocket 404. Thereafter, tubing string 410 may be lowered further into the wellbore or the portion of acoustic coupling element 412 containing piezoelectric ceramic elements 418 may be shifted downwardly to created a mechanical connection, in this case, a compressive force between the portion of acoustic coupling element 412 containing piezoelectric ceramic elements 418 and a lower surface of side pocket 404.

In the illustrated embodiment, piezoelectric ceramic elements 416 of acoustic coupling element 406 are oppositely disposed relative to piezoelectric ceramic elements 418 of acoustic coupling element 412 on outer and inner surfaces of wellbore tubular 404. To enhance power transfer efficiency, acoustic coupling element 406 is preferably mechanically coupled to the outer surface wellbore tubular 404 and acoustic coupling element 412 is preferably mechanically coupled to the inner surface of wellbore tubular 304 as described above. In the illustrated embodiment, acoustic coupling element 406 is mechanically coupled to the outer surface wellbore tubular 404 by a bonding layer 422 such as a high temperature epoxy. In addition, acoustic coupling element 406 is mechanically coupled to the outer surface wellbore tubular 404 by a compressive force generated by clamp assembly 424.

In operation, the surface controller is used to send electrical signals in the form of electrical power and/or data streams to acoustic coupling element 412 on an intermittent or continuous basis. The electrical signals are converted to acoustic signals in acoustic coupling element 412 by piezoelectric ceramic elements 418. The acoustic signals are communicated through the wall of wellbore tubular 402 and are received by piezoelectric ceramic elements 416 of acoustic coupling element 406 that convert the acoustic signals to electrical signals.

In this implementation, piezoelectric ceramic elements 418 act as a piezoelectric generator using the indirect piezoelectric effect to generate stress waves that are transmitted through the wall of wellbore tubular 402 where the received waves are converted to electric signals using the direct piezoelectric effect by piezoelectric ceramic elements 416, which act as a piezoelectric receiver. In a similar manner, data may be transmitted from acoustic coupling element 406 to acoustic coupling element 412 by piezoelectric ceramic elements 416 which act as a piezoelectric generator using the indirect piezoelectric effect to generate stress waves that are transmitted through the wall of wellbore tubular 402 where the received waves are converted to electric signals using the direct piezoelectric effect by piezoelectric ceramic elements 418, which act as a piezoelectric receiver. To enhance power transfer efficiency, power and data transmissions between acoustic coupling elements 406, 412 may be accomplished through acoustic signals at the harmonic or a higher order resonance frequency of piezoelectric ceramic elements 416, 418.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. An apparatus for transmitting electrical power and data between downhole devices comprising:

a wellbore tubular having a wall;

an electrical device positioned in a wellbore region to an exterior of the wellbore tubular;

a first acoustic coupling element positioned to the exterior of the wellbore tubular and electrically connected to the electrical device; and a second acoustic coupling element positioned to an interior of the wellbore tubular, the second acoustic coupling element operable to transmit electrical power to and receive data from the first acoustic coupling element through communication of acoustic signals through the wall of the wellbore tubular.

2. The apparatus as recited in claim 1 wherein the second acoustic coupling element further comprises a piezoelectric generator and wherein the first acoustic coupling element further comprises a piezoelectric receiver.

3. The apparatus as recited in claim 1 wherein the first acoustic coupling element is operable to transmit data to the second acoustic coupling element through communication of acoustic signals through the wall of the wellbore tubular.

4. The apparatus as recited in claim 1 wherein the acoustic signals are communicated at a resonance frequency of the first and second acoustic coupling elements.

5. The apparatus as recited in claim 1 wherein at least one of the first and second acoustic coupling elements is mechanically coupled to a surface of the wall of the wellbore tubular.

6. The apparatus as recited in claim 1 wherein the first and second acoustic coupling elements are in communicative proximity to a surface of the wall of the wellbore tubular.

7. The apparatus as recited in claim 1 wherein the first and second acoustic coupling elements are oppositely disposed relative to each other on an outer surface of the wall of the wellbore tubular and an inner surface of the wall of the wellbore tubular, respectively.

8. The apparatus as recited in claim 1 wherein the second acoustic coupling element is electrically coupled to a surface controller by an electrical cable.

9. The apparatus as recited in claim 1 wherein the electrical device is selected from the group consisting of downhole sensors, downhole controllers, downhole actuators and fluid flow control devices.

10. A method for transmitting electrical power and data between downhole devices comprising:

disposing a first acoustic coupling element to an exterior of a wellbore tubular having a wall, the first acoustic coupling element electrically connected to an electrical device positioned to the exterior of the wellbore tubular;

positioning a second acoustic coupling element to an interior of the wellbore tubular;

transmitting electrical power from the second acoustic coupling element to the first acoustic coupling element through communication of acoustic signals through the wall of the wellbore tubular; and receiving data at the second acoustic coupling element from the first acoustic coupling element through communication of acoustic signals through the wall of the wellbore tubular.

11. The method as recited in claim 10 wherein disposing the first acoustic coupling element to the exterior of the wellbore tubular further comprises mechanically coupling the first acoustic coupling element to an outer surface of the wall of the wellbore and wherein positioning the second acoustic coupling element to the interior of the wellbore tubular further comprises mechanically coupling the second acoustic coupling element to an interior surface of the wall of the wellbore tubular.

12. The method as recited in claim 10 wherein disposing the first acoustic coupling element to the exterior of the wellbore tubular further comprises positioning the first acoustic coupling element in communicative proximity of the wall of the wellbore tubular and wherein positioning the second acoustic coupling element to the interior of the wellbore tubular further comprises positioning the second acoustic coupling element in communicative proximity of the wall of the wellbore tubular.

13. The method as recited in claim 10 wherein transmitting electrical power from the second acoustic coupling element to the first acoustic coupling element through communication of acoustic signals through the wall of the wellbore tubular further comprises exciting a piezoelectric generator of the first acoustic coupling element and a piezoelectric receiver of the second acoustic coupling element.

14. The method as recited in claim 13 wherein exciting the piezoelectric generator of the first acoustic coupling element and the piezoelectric receiver of the second acoustic coupling element further comprises exciting the piezoelectric generator and the piezoelectric receiver at a resonance frequency.

15. The method as recited in claim 10 wherein transmitting electrical power from the second acoustic coupling element to the first acoustic coupling element through communication of acoustic signals through the wall of the wellbore tubular further comprises electrically coupling the second acoustic coupling element to a surface controller by an electrical cable.

16. The method as recited in claim 10 further comprising transmitting data from the first acoustic coupling element to the second acoustic coupling element through communication of acoustic signals through the wall of the wellbore tubular.

17. An apparatus for transmitting electrical power and data between downhole devices comprising:

a surface controller;

a wellbore tubular having a wall;

an electrical device positioned in a wellbore region to an exterior of the wellbore tubular;

a first acoustic coupling element including a piezoelectric receiver positioned to the exterior of the wellbore tubular and in communicative proximity of the wall of the wellbore tubular, the first acoustic coupling element electrically connected to the electrical device; and a second acoustic coupling element having a piezoelectric generator positioned to an interior of the wellbore tubular, in communicative proximity of the wall of the wellbore tubular and oppositely disposed relative to the first acoustic coupling element, the second acoustic coupling element electrically coupled to the surface controller by an electrical cable, the second acoustic coupling element operable to transmit electrical power to and receive data from the first acoustic coupling element through communication of acoustic signals through the wall of the wellbore tubular.

18. The apparatus as recited in claim 17 wherein the first acoustic coupling element is operable to transmit data to the second acoustic coupling element through communication of acoustic signals through the wall of the wellbore tubular.

19. The apparatus as recited in claim 17 wherein the acoustic signals are communicated at a resonance frequency of the piezoelectric generator and the piezoelectric receiver.

20. The apparatus as recited in claim 17 wherein at least one of the first and second acoustic coupling elements is mechanically coupled to a surface of the wall of the wellbore tubular.

* * * * *